US012006107B2

(12) United States Patent
Gessler, Jr. et al.

(10) Patent No.: US 12,006,107 B2
(45) Date of Patent: Jun. 11, 2024

(54) PRODUCT ENGAGEMENT PACKAGING SYSTEM AND DISPLAY

(71) Applicant: Delkor Systems, Inc., St. Paul, MN (US)

(72) Inventors: Richard J. Gessler, Jr., Stillwater, MN (US); Aaron J. Donlon, Redondo Beach, CA (US); Thomas Partridge, Inver Grove Heights, MN (US)

(73) Assignee: Delkor Systems, Inc., St. Paul, MN (US)

( * ) Notice: Subject to any disclaimer, the term of this patent is extended or adjusted under 35 U.S.C. 154(b) by 0 days.

(21) Appl. No.: 18/333,621

(22) Filed: Jun. 13, 2023

(65) Prior Publication Data

US 2023/0331431 A1 Oct. 19, 2023

Related U.S. Application Data

(63) Continuation of application No. 16/788,802, filed on Feb. 12, 2020, now abandoned, which is a (Continued)

(51) Int. Cl.
*B65D 5/54* (2006.01)
*B65B 5/08* (2006.01)

(Continued)

(52) U.S. Cl.
CPC ..... *B65D 5/5445* (2013.01); *B65B 5/08* (2013.01); *B65D 5/5028* (2013.01); *B65D 77/0413* (2013.01); *B65D 2577/043* (2013.01)

(58) Field of Classification Search
CPC ..... B65D 5/02; B65D 5/52; B65D 5/5028; B65D 5/5445; B65D 5/50; B65D 5/5233;

(Continued)

(56) References Cited

U.S. PATENT DOCUMENTS 3,302,776 A 2/1967 Sparks
3,759,378 A * 9/1973 Werth ..... B65D 21/0205 206/192

(Continued)

OTHER PUBLICATIONS

Mar. 19, 2019 USPTO Office Action (U.S. Appl. No. 15/973,898)—Our Matter 5677.

(Continued)

*Primary Examiner* — Andrew M Tecco
(74) *Attorney, Agent, or Firm* — Forsgren Fisher McCalmont DeMarea Tysver LLP; James M. Urzedowski; Daniel A. Tysver

(57) ABSTRACT

A method of providing a convertible packaging having a storage configuration and a display configuration is described herein. The package is made from a package blank having panels adhesively engaged together to form the package. The assembled package having an interior defined by a plurality of walls. The bottom and/or two opposing walls of the package have a pattern of discrete material depositions adhesively deposited thereon. The depositions each have a height as measured from the wall that they are mounted upon. The presence and height of the opposing depositions providing a mechanical engagement surface against which an adjacent product container is biased or held against, to prevent the product container from falling forward or out of the package when the package is in the display configuration, even as individual product containers are removed from the package by customers.

8 Claims, 14 Drawing Sheets

Related U.S. Application Data continuation of application No. 15/973,898, filed on May 8, 2018, now abandoned.

(51) Int. Cl.
*B65D 5/50* (2006.01)
*B65D 77/04* (2006.01)

(58) Field of Classification Search
CPC .. B65D 5/5021; B65D 5/5052; B65D 25/107; B65D 77/0413; B65D 2577/043; B31B 2100/00
See application file for complete search history.

(56) References Cited

U.S. PATENT DOCUMENTS 3,927,761 A * 12/1975 Boyle ..... B65D 5/18 206/756
4,363,400 A * 12/1982 Lewis ..... B65D 5/5011 206/562
4,377,235 A * 3/1983 Carver ..... B65D 71/14 206/460
5,782,732 A * 7/1998 Herrin ..... B31B 50/36 493/131
5,823,332 A 10/1998 Clausen
5,887,717 A * 3/1999 Anderson ..... B65D 71/10 206/460
6,039,179 A 3/2000 Weder et al.
6,306,070 B1 * 10/2001 Herrin ..... B31B 50/00 493/125
6,409,077 B1 6/2002 Telesca et al.
6,431,363 B1 * 8/2002 Hacker ..... B65D 5/5038 229/101
6,575,299 B1 * 6/2003 Kinigakis ..... B65D 5/548 206/541
6,672,035 B1 1/2004 Simonsen et al.
8,136,697 B2 * 3/2012 Hackney ..... B65D 83/0876 221/303
9,187,207 B2 * 11/2015 Gessler, Jr. ..... B65D 5/54
9,555,919 B2 * 1/2017 Gessler, Jr. ..... B65D 5/4608
9,809,349 B2 * 11/2017 Gessler, Jr. ..... B65D 5/54
9,938,040 B2 * 4/2018 Buscema ..... B65D 5/02
10,683,132 B2 * 6/2020 Purkey ..... B65B 43/10
10,974,862 B2 * 4/2021 Hörenbaum ..... B65D 5/20
2002/0088736 A1 * 7/2002 Liu ..... B65D 25/107 206/526
2009/0272756 A1 * 11/2009 Hackney ..... A47F 1/08 221/282
2013/0081359 A1 * 4/2013 Nguyen ..... B65D 5/328 53/410
2016/0159513 A1 6/2016 Frost
2018/0029747 A1 * 2/2018 Purkey ..... B65B 43/10

OTHER PUBLICATIONS

Nov. 12, 2019 USPTO Office Action (U.S. Appl. No. 15/973,898)—Our Matter 5677.
Jun. 24, 2022 USPTO Office Action (U.S. Appl. No. 16/788,802)—Our Matter 6031.
Nov. 23, 2022 USPTO Office Action (U.S. Appl. No. 16/788,802)—Our Matter 6031.
Mar. 13, 2023 USPTO Office Action (U.S. Appl. No. 16/788,802)—Our Matter 6031.

* cited by examiner

PRODUCT ENGAGEMENT PACKAGING SYSTEM AND DISPLAY

CROSS-REFERENCE TO RELATED APPLICATIONS

The present application is a continuation application claiming priority to U.S. patent application Ser. No. 16/788,802, filed on Feb. 12, 2020 and published as U.S. Publication Number 2020/0180811, which in-turn is a continuation application of U.S. patent application Ser. No. 15/973,898, filed on May 8, 2018 and published as U.S. Publication Number 2019/0344924 (now abandoned), the entire content of each of which are incorporated herein by reference.

FIELD OF THE INVENTION

The present disclosure is directed to retail or shelf ready and/or shipping packages, packaging systems and methods of manufacturing and using same. Such packages may be used for shipping a plurality of product containers, and may comprise a package housing of which a portion, such as a lid or top, is separable from a base or bottom display portion to convert the package from a shipping or storage container to a retail ready display that the product containers remain housed in until their individual removal by customers.

SUMMARY

Packages of the type described above are used to contain and display product containers having a wide range of shapes, sizes and weights. To accommodate the wide variety of different retail products that exist, such packages may utilize unique retaining structures such as slots, grooves, tabs, or other features of the package material itself to hold individual product containers in place within the confines of the package. Such material attributes however, may increase the complexity of the packages manufacturing process as additional folds, reinforcement of desired areas, the cutting away of others, etc. are imposed on the package blank so as to allow the desired retaining structure to be formed as necessary.

Some packages may go even further by employing inserts, such as trays or separating panels of paperboard, corrugated material or even plastic to retain product containers in place within the package interior. The use of such inserts not only increases the cost of the shipping package but also the complexity of the package assembly and loading processes.

In some packages, adhesives, such as those providing a temporary bond, a frangible bond other type of chemical adhesive between the package interior and the product container, are used to hold the product containers in place. The use of such adhesives however, increase the potential cost of the package and complexity of the packaging processor as such materials and their formulation must be utilized with precision and care.

For product containers having particularly odd or asymmetric shapes, or that are disproportionately top heavy, or are just difficult to retain in place within the package for whatever reason (such as when individual product containers are removed from the display), the package and/or packaging process might rely on physical retaining elements, adhesives, and/or unique positioning of the product containers within the package to ensure their security therein. Such unique loading configurations may require complex loading apparatuses or even hand loading of the package, both of which drive the cost of packaging the product up.

Thus, a need exists for a relatively low cost, broad application packaging solution which will allow a package shipping/display to retain product containers in place within the package but without increasing the material complexity of the package or dramatically increasing its cost to manufacture, assemble or load.

Embodiments of the present disclosure are directed to packages, systems and methods of the type described above, which meet this need by utilizing discrete depositions of material deposited at select locations within the package interior that act to mechanically grip, lock, bias or otherwise secure the position of individual product containers adjacent to one another within the package.

These material depositions maintain the position of each product containers within the package even when adjacent product containers are removed from the package. In some embodiments, the depositions are applied with precision using the same hardware commonly used to apply adhesives or other material to a packaging blank and using well known application techniques, which may be a part of the already in place package assembly process.

In some embodiments the depositions take the from of discrete quantities of a thermosetting plastic or adhesive that is allowed to cure or dry before product containers are inserted into the package and placed in contact therewith. The depositions may be applied to any interior surface of the package or package blank during or after the package assembly process; and may be deposited in accordance to any desired pattern. The physical characteristics of each deposition may vary in terms of shape (e.g. droplet, line, etc.), thickness (height), adhesion characteristics, etc.

The use of such depositions avoids the need for additional inserts or structural changes being made to the package in order to retain product containers in place regardless of their individual shapes, sizes, or configurations.

DETAILED DESCRIPTION

Figure 1:
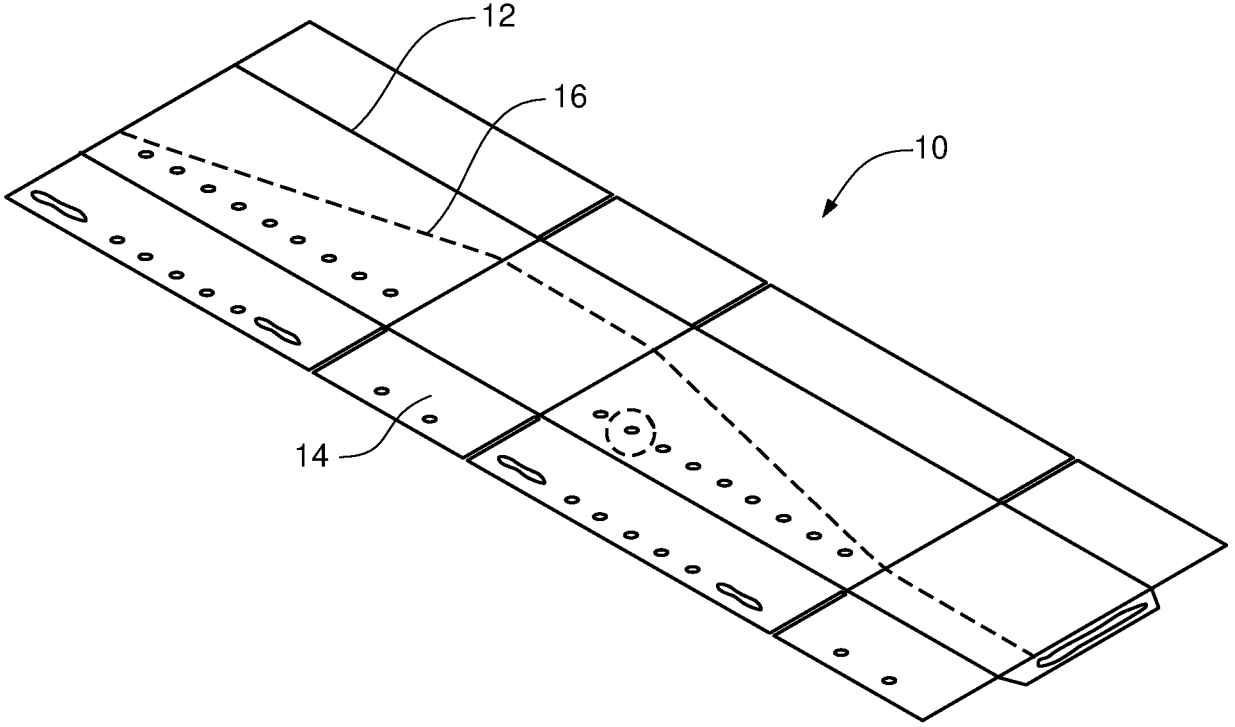
FIG. 1 is a perspective view of a package blank.

As indicated above, embodiments of the present invention are directed to packages for the retention, shipping and/or display of multiple product containers. Such packages must first be assembled from a package blank, such as the exemplary blank 10 shown in FIG. 1. The blank 10 will have a plurality of fold lines 12 and panels 14 (and in some embodiments, a perforated tear line 16 about which more will be discussed below), which when properly aligned and selectively manipulated, will form an open package 20, such as is shown in FIG. 3; and which is then ready to receive products or product containers 30 such as are shown in FIG. 4 through the open top 22 of the package 20.

Suitable examples of blanks 10 and packages 20 formed therefrom that may be utilized in the manner shown in FIGS. 1-14 are shown and described in U.S. Pat. Nos. 9,187,207; 9,555,919; and 9,809,349 the entire contents of each being incorporated herein by reference.

Figures 2A, 2B:
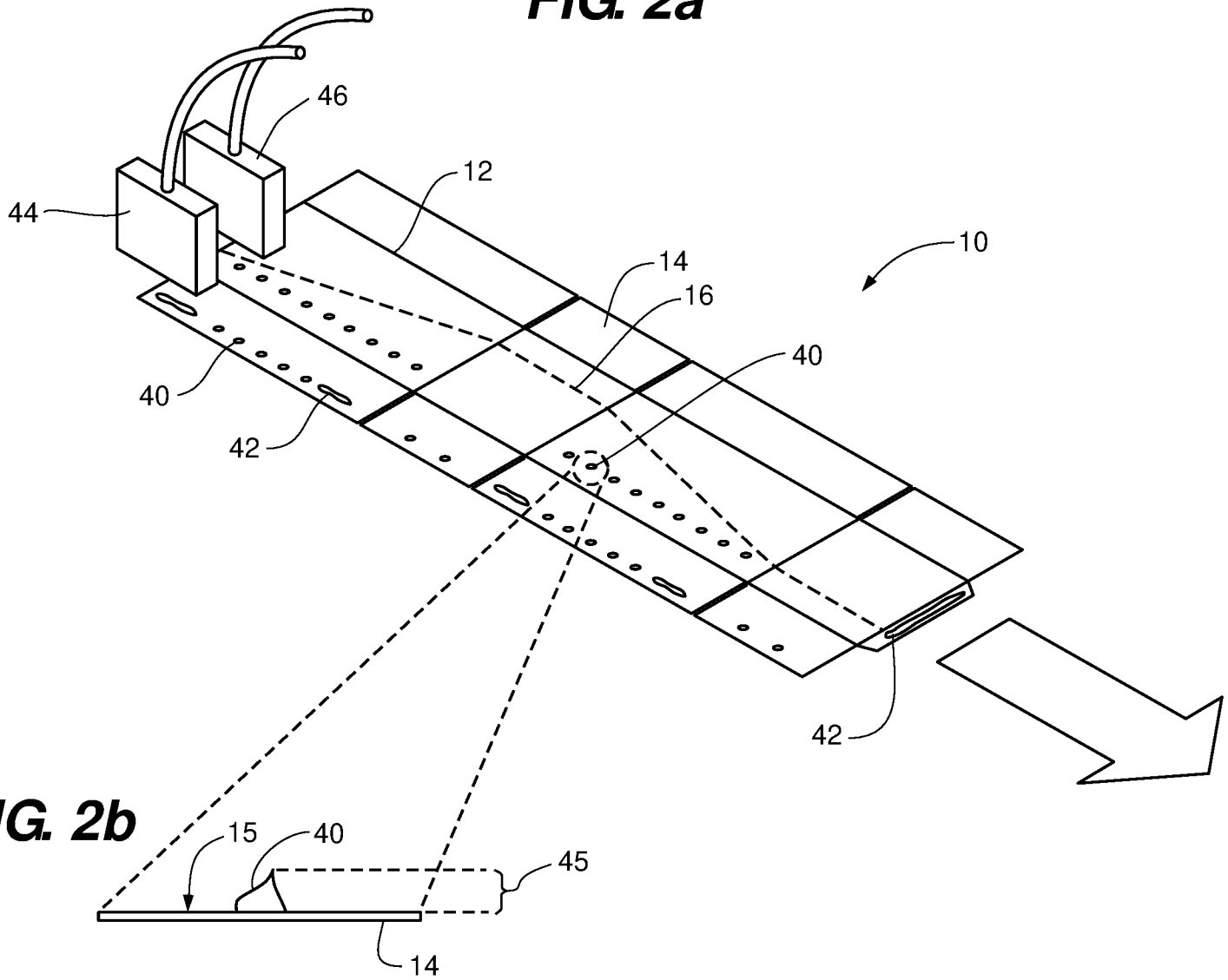
FIG. 2*a* is a perspective view of the blank shown in FIG. 1 having material depositions applied thereto via a pair of applicator heads.
FIG. 2*b* is a highlighted side view of a portion of the blank shown in FIG. 2*a* depicting the relative height of a material deposition relative to the surface of the blank.
Figure 3:
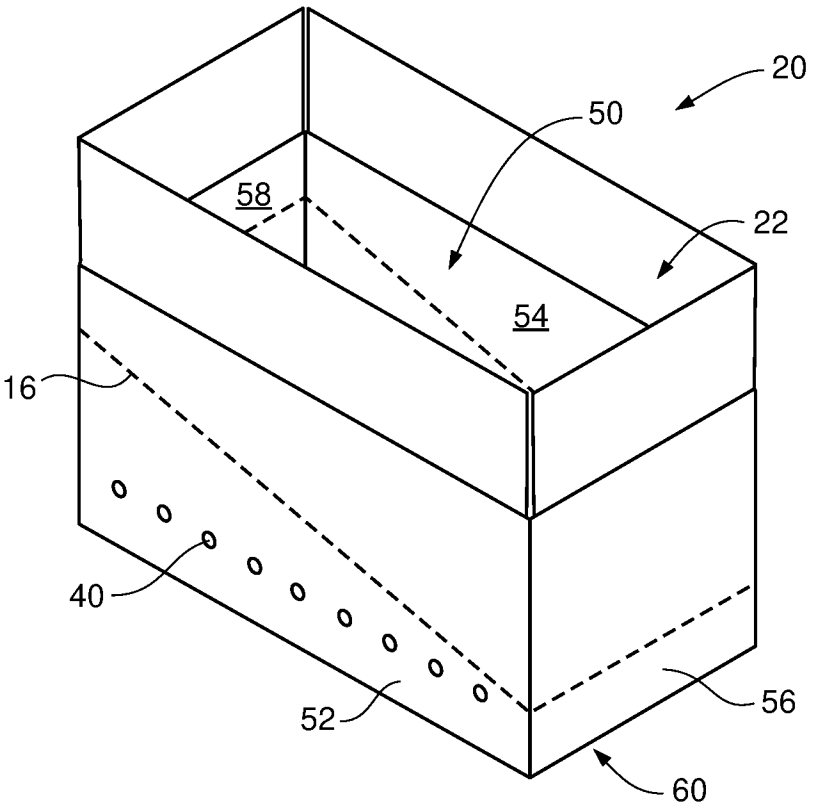
FIG. 3 is a perspective view of a package formed from the blank shown in FIGS. 1-2.
Figure 4:
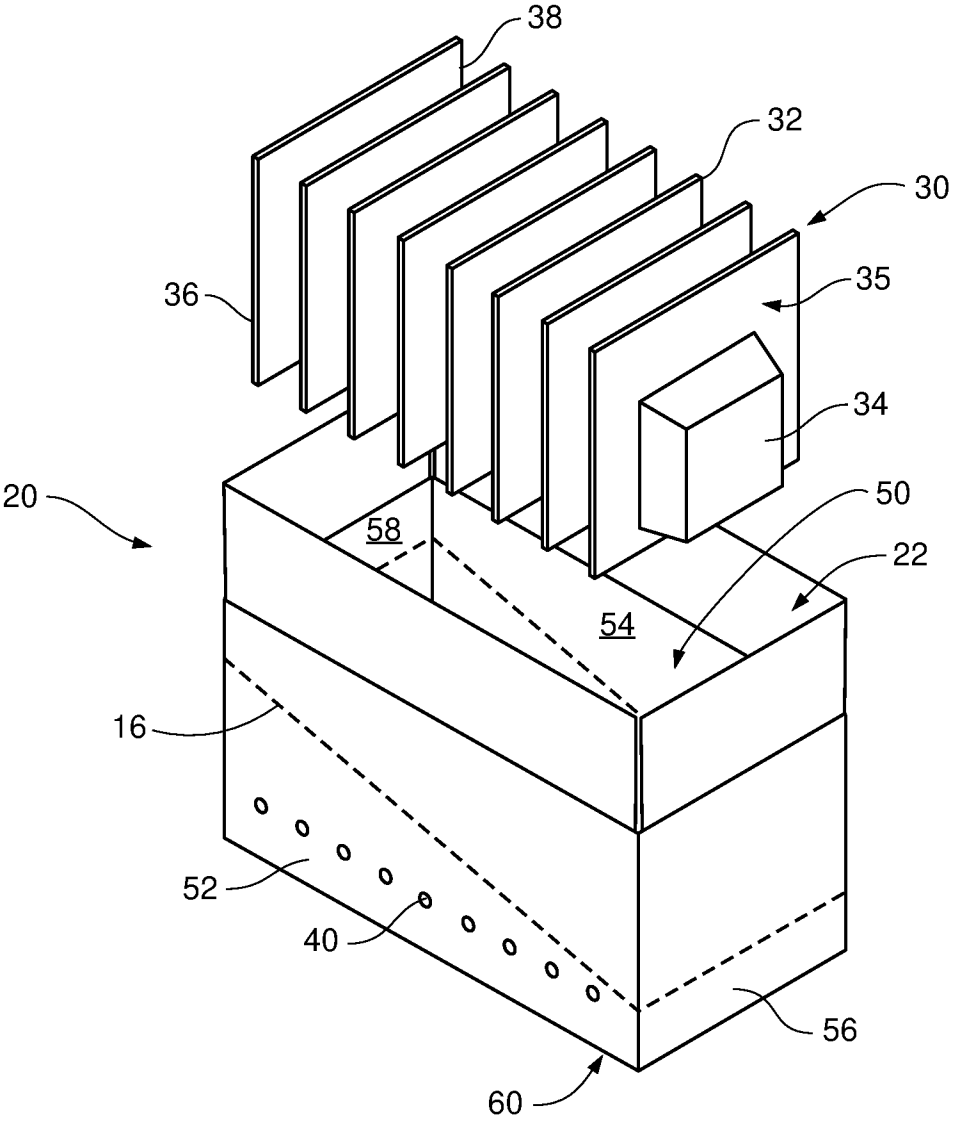
FIG. 4 is a perspective view of the package shown in FIG. 3 with product containers being loaded into the package interior through the open top of the package.

In some embodiments, such as depicted in FIG. 2*a*, in order to properly assembly the package 20 from a blank 10, the blank 10 must first have an adhesive such as a hot melt adhesive, thermoset plastic, or other curable fluid 42 applied to selected panels 14 so that such panels will retain to those adjacent thereto and be held together to provide and retain the package 20 (such as is shown in FIG. 3) in its final form. In some embodiments, adhesive 42 is applied in accordance to a pre-programmed pattern that depositing heads 44 are provided with by computer program or other type of automated control.

As part of the program or pattern of deposition, the head or heads 44 may be tasked with applying discrete depositions 40 of adhesive 42 to regions of the blank 10 that are not destined to come in contact with other panels 14 as part of the package formation process. These discrete depositions 40, which are not intended to be brought in contact with adjacent panels 14 may be the same composition as the adhesive 42 and applied by the same depositing head 44 or type of head; or may be of a different material composition and applied with a separate depositing head 46 that is distinctive and separately controlled from the adhesive depositing head 44.

An example of a material that the depositions 40 may be composed of include but is not limited to Hot Melt Adhesives (HMAs) and particularly ones that are Ethylene Vinyl-Acetate (EVA)-based. Other materials that may be used in the formulation of depositions 40 include TECHNOMELT® SUPRA™ 400 COOL from the Henkel company and Advantra® PHC 9254 available from the H.B. Fuller company.

Regardless of the type of material used to form the depositions 40, key aspects of each deposition 40 are not necessarily those directed to its chemical properties per se, but rather the material's ability to form a bead or line of material that will adhere to the surface 15 of the panel 14 that it is deposited on (such as in the manner shown in FIG. 2*a*), and provide a bead or line of material that can act as a physical barrier to objects (such as product containers 30 shown in FIG. 4) positioned against the deposition 40 once the material of the deposition 40 has cured or set.

An example of the physically projecting nature of the deposition 40 (be it in the form of a bead or line) is illustrated in FIG. 2*b*, where it can be seen that the deposition 40 has a distinct height 45 of between 0.050 inches (~1.25-1.30 mm) to about 0.095 inches (~2.4-2.5 mm) as measured from the surface 15 of the panel 14 that the deposition is placed upon.

It is the combination of the height and the adherence of the depositions 40 to the surface of the package panels 14 that allows the depositions 40 to act as a structural feature for retaining product containers 30 in a predetermined position within the package interior 50 such as is shown in FIGS. 4-9.

Returning to FIGS. 1-2, the package assembly and loading process follows the application of adhesive 42 and depositions 40 to the surface of selected panels of the package blank 10. The blank 10 is manipulated by various package assembly interfaces (not shown) to form the open package shown in FIG. 3. Product containers 30 are inserted into the package interior 50 through the open top 22 of the package 20 such as in the manner shown in FIGS. 4-5.

Figure 5:
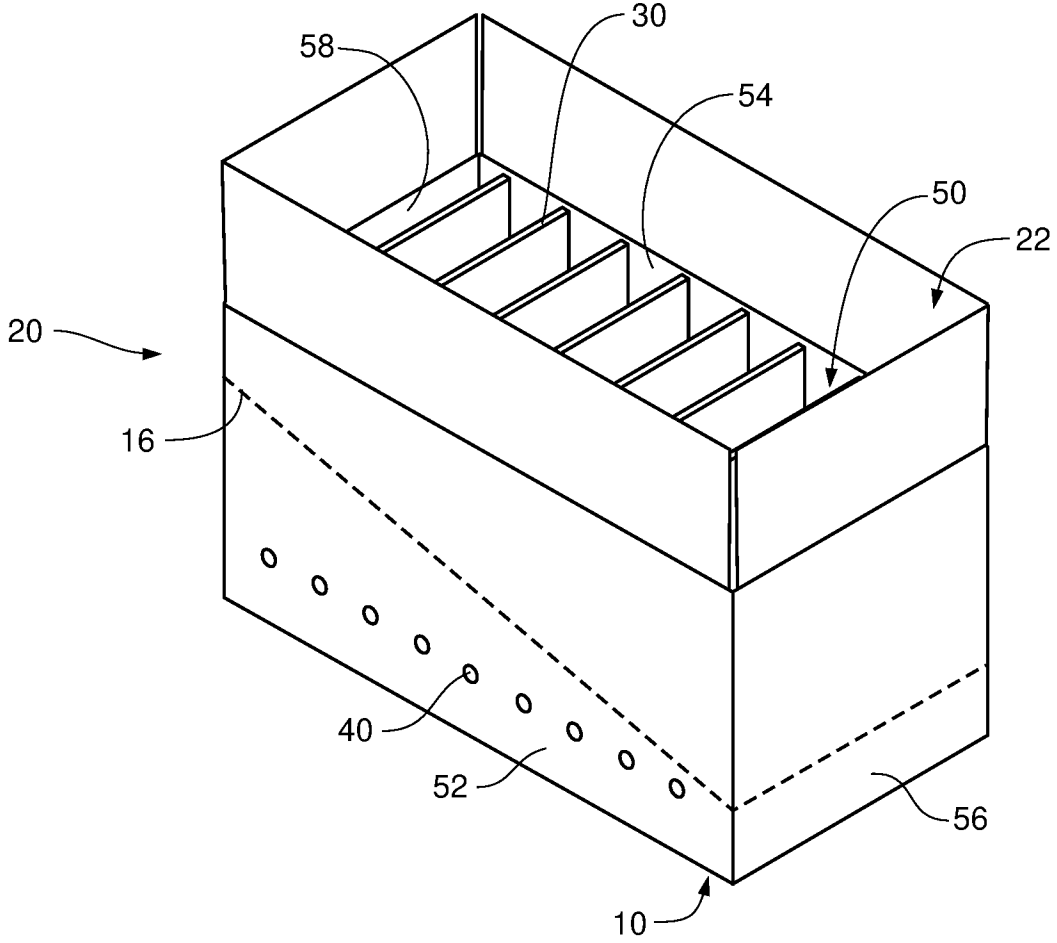
FIG. 5 is a perspective view of the package shown in FIG. 4, wherein the package is shown fully loaded with a plurality of product containers therein.

Note that in the embodiment shown in FIGS. 4-5 the product containers 30 are comprised of a flat, (typically a cardboard or corrugated) retaining panel 32 against which a product item 34 is contained by adhesion or plastic/film wrapping/encapsulation. This sort of container is often referred to as a "blister pack". Such product containers 30 have a tendency to want to fall forward, in the direction of the side of the panel 32 that the product 34 is engaged to, as a consequence of the weight of the product 34 and the tall, thin nature of the support panel 32.

When the blank 10 as previously shown (see FIGS. 1-2) and described is folded or otherwise formed into a package 20, such as is shown in FIGS. 3-6, the panels 14 are positioned such that some panels form side walls 52 and 54 a front wall 56, a rear wall 58 and a bottom 60 from which the walls extend vertically therefrom. The depositions 40 are positioned and arranged along each of the side walls 52 and 54, such that the product containers will be braced or otherwise positioned to mechanically engage the depositions 40 when the product containers are place within the package interior 50 such as in the manner shown in FIGS. 4 and 5. The size of the package 20 and product containers 30 are coordinated to ensure that the product containers are readily able to be loaded into the confines of the package interior 50, as defined by the walls 52, 54, 56 and 58 and resting on the bottom 60; but the depositions 40 have sufficient height 45 (see FIG. 2*b*) to engage at least one surface of the product container 30 positioned adjacent thereto.

More specifically, and as shown in FIG. 4 (and contextually in FIGS. 5-9), the product containers 30 are loaded into the package interior 50 such that each retaining panel 32 is positioned such that each vertical side 36 and 38 of the retaining panel 32 is contacted by at least one deposition 40 extending from corresponding side walls 52 and 54 of the package 20. The depositions 40 are adjacent to, or in contact with, the product facing side 35 of the retaining panel 32 and at a height sufficient to prevent the container 30 from falling forward toward the front wall 56 or otherwise dramatically shifting in position.

Figure 7:
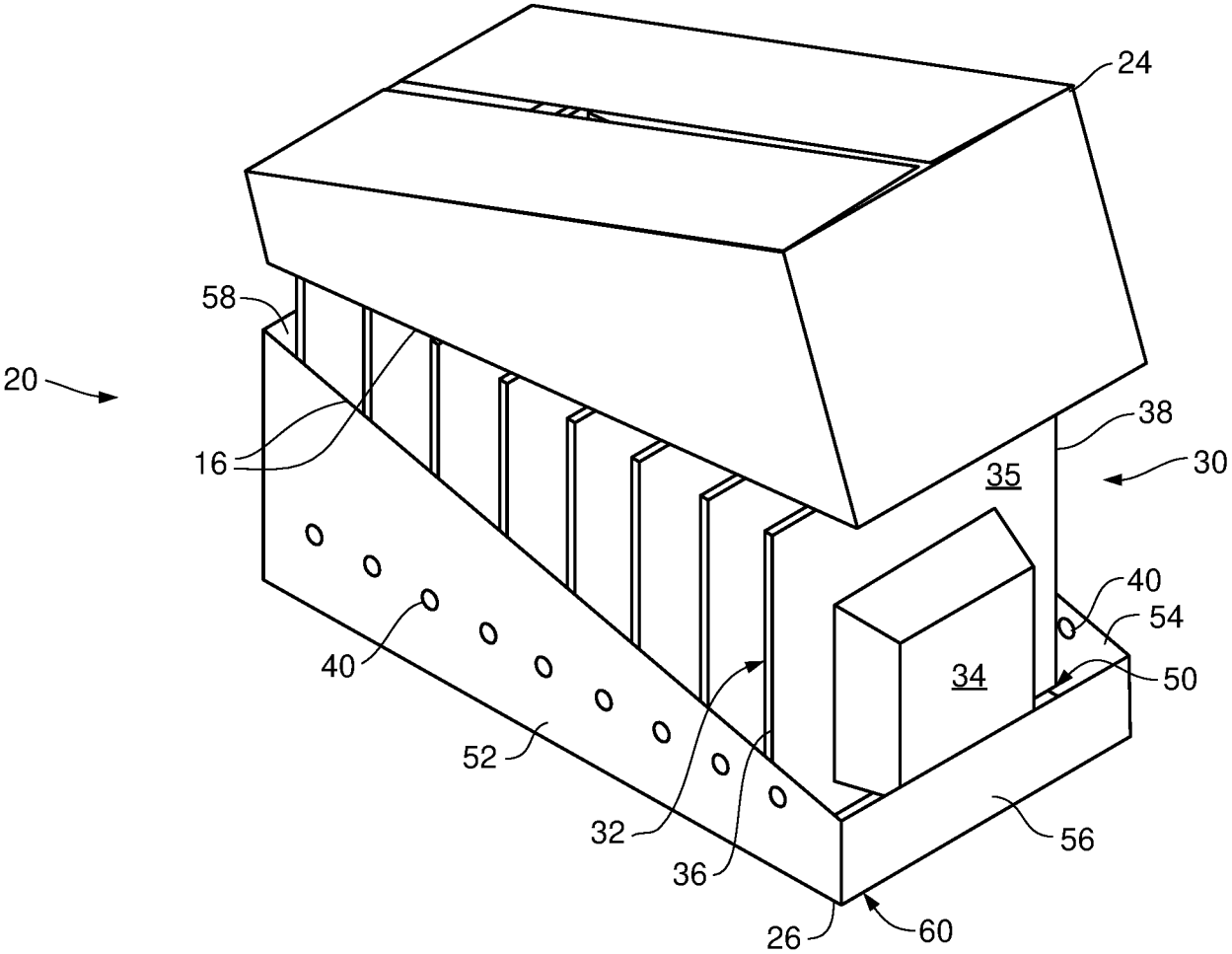
FIG. 7 is a perspective view of the package shown in FIG. 6 wherein the top portion of the package is removed along a tear line from a retail display base.
Figure 8:
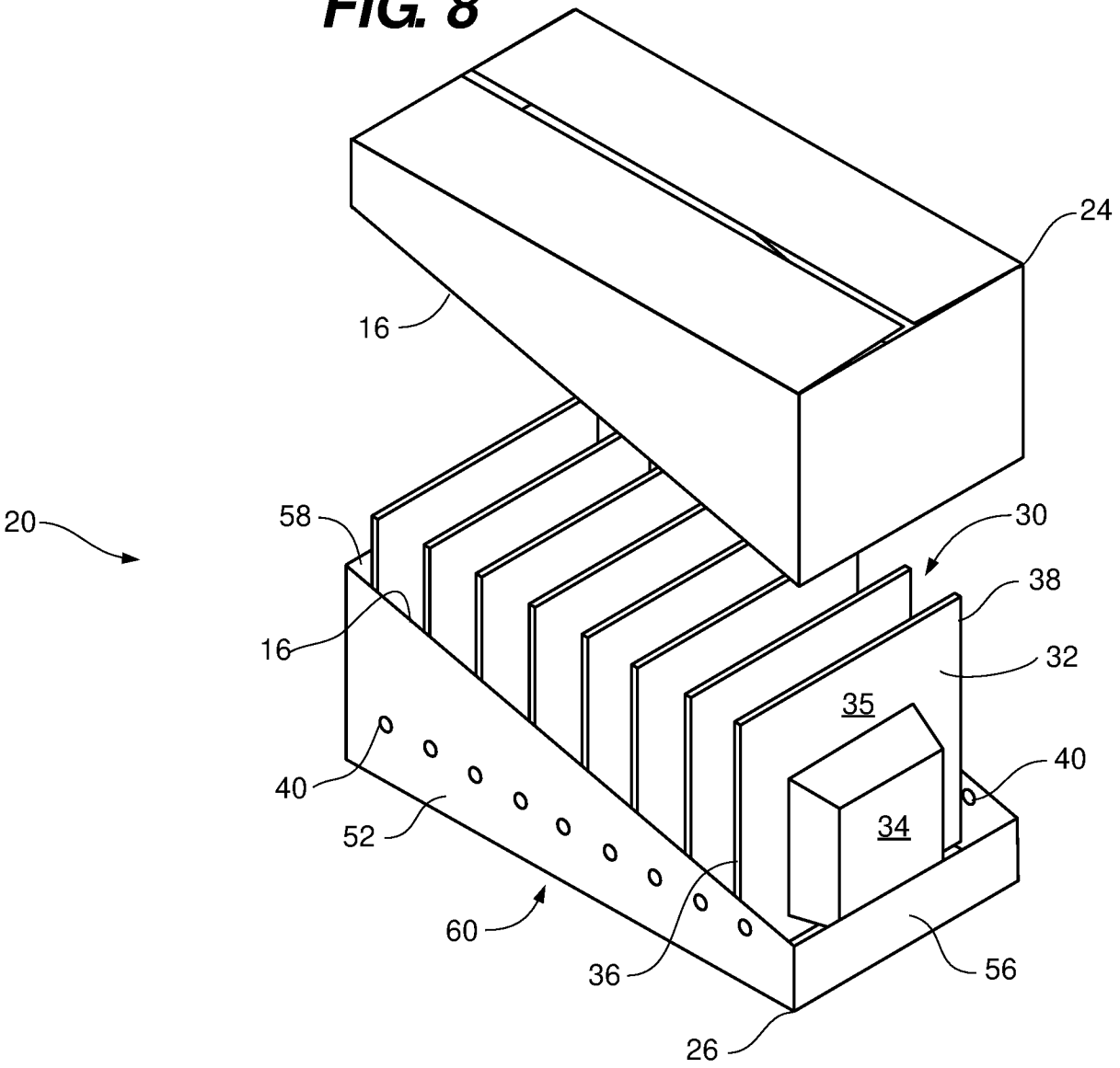
FIG. 8 is a perspective view of the package shown in FIG. 7 wherein the arrangement of product containers within the retail display base are shown relative to the material depositions.
Figure 9:
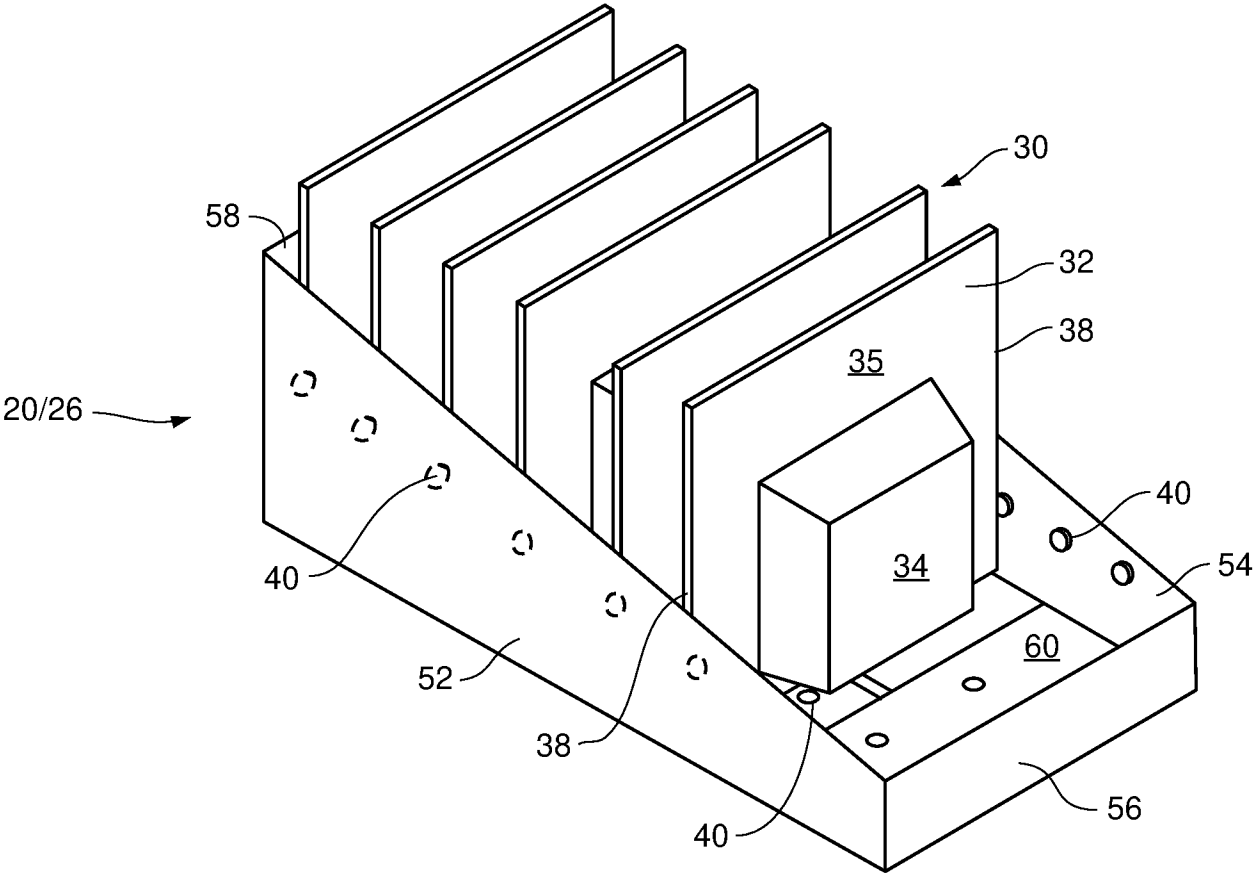
FIG. 9 is a perspective, close-up view of the retail base portion of the package shown in FIG. 8 but with initial product containers removed to illustrate the nature of the material depositions physical retention of individual product containers within the retail base.

As can best be seen in FIGS. 7-9 the opposing side walls 52 and 54 each have a what is effectively a "line" of depositions that are arranged such that a individual deposition on one wall 52 is opposite the deposition located on the opposing side wall 54 both in terms of relative height on the respective wall as measured from the bottom 60 and distance from the front wall 56 and back wall 58 manner of the deposition pattern (see FIG. 2*a* for illustration of the manner in which the opposing pattern of depositions are applied to the blank 10). In at least one embodiment, such as is shown in FIGS. 7-9 the distance between opposing depositions 40 on opposing walls 52 and 54 is less than the width of the product container 30 positioned adjacent to the depositions.

In some embodiments the depositions 40 are applied to the side walls 52 and 54 in a pattern on one wall that is mirrored on the other.

In some embodiments, depositions 40 may be placed on the bottom 60 of the package (shown in FIG. 9) to provide additional securement to the product container 30 positioned adjacent thereto. The height (see FIG. 2*a*) of the bottom applied depositions 40, which extend upward from the bottom 60, engage the product side surface 35, of panel 32, of each product container 30; and act as a barrier to prevent of limit the tendency of product containers 30 to slide or fall forward within the package 20/base 26, such as may otherwise occur when product containers are individually removed from the package 20/base 26 in the retail setting.

Figure 6:
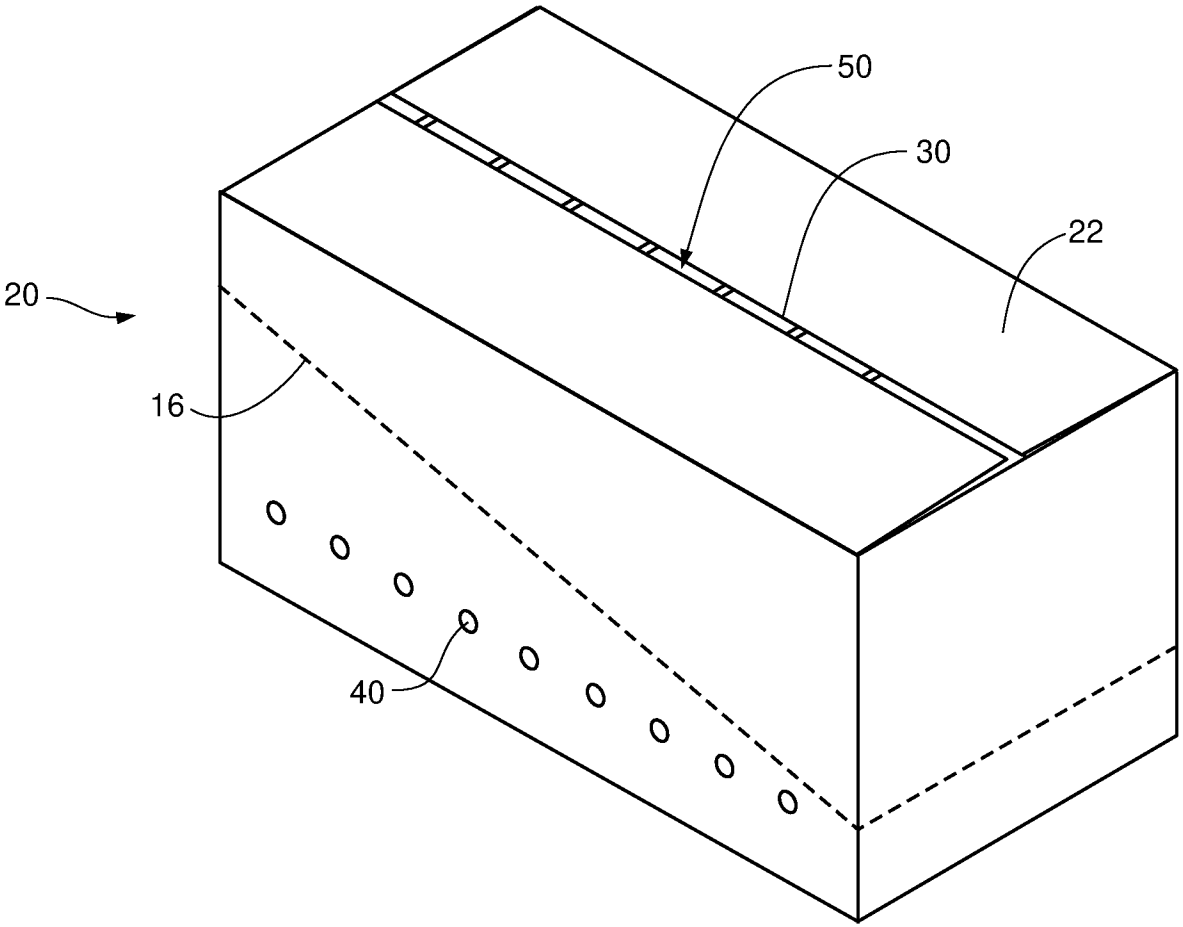
FIG. 6 is a perspective view of the package shown in FIG. 5, wherein the flaps that define the opening have been closed to fully contain the product containers within the package in anticipation of shipping.

Once the product containers 30 are loaded into the package interior in the manner described above, the open top 22 is closed such as in the manner shown in FIG. 6 to seal the package 20 and enclose the product containers 30 therein for storage or delivery.

Eventually, such as when the package 20 is ready for use in a retail setting, the package 20 is convertible from a shipping/storage configuration that enclosed the product containers 30 to a display configuration wherein the product containers are both visible and readily accessible to consumers. An illustration of this conversion is depicted in FIGS. 7 and 8 wherein it is shown that the convertibility from enclosure to display is achieved by essentially separating the package 20 into two components: a lid or top portion 24 and a display tray or base portion 26 which have a readily separable interface therebetween defined by the aforementioned perforated tear line 16. By simply pulling the top portion 24 up and away from the base portion 26 along the interface defined by the tear line 16, the top portion is removed and the package 20 converted from an enclosure to a retail ready display.

As can be seen in FIGS. 7 and 8, the base portion 26 is comprised of lower sections (i.e sections of the walls below the tear line 16) of side walls 52 and 54, front wall 56 (which in some embodiments may be removed entirely as part of the top portion 24) and rear wall 58. The product containers 30 remain up-right and in a displayed within the base portion 26 via their contact with the depositions 40 in the manner previously described, and/or by being inclined toward the rear wall 58. The presence of depositions 40 on the side walls 52 and 54 as well as on the bottom 60 of the base portion 26 provides mechanical engagement with each adjacent product container 30 to ensure that even when initial product containers 30 (i.e. those closest to the front wall 56 of the base portion 26) are removed from the base portion 26 the remaining product containers 30 remain in their up-right and displayed position such as in the manner shown in FIG. 9.

Figure 10:
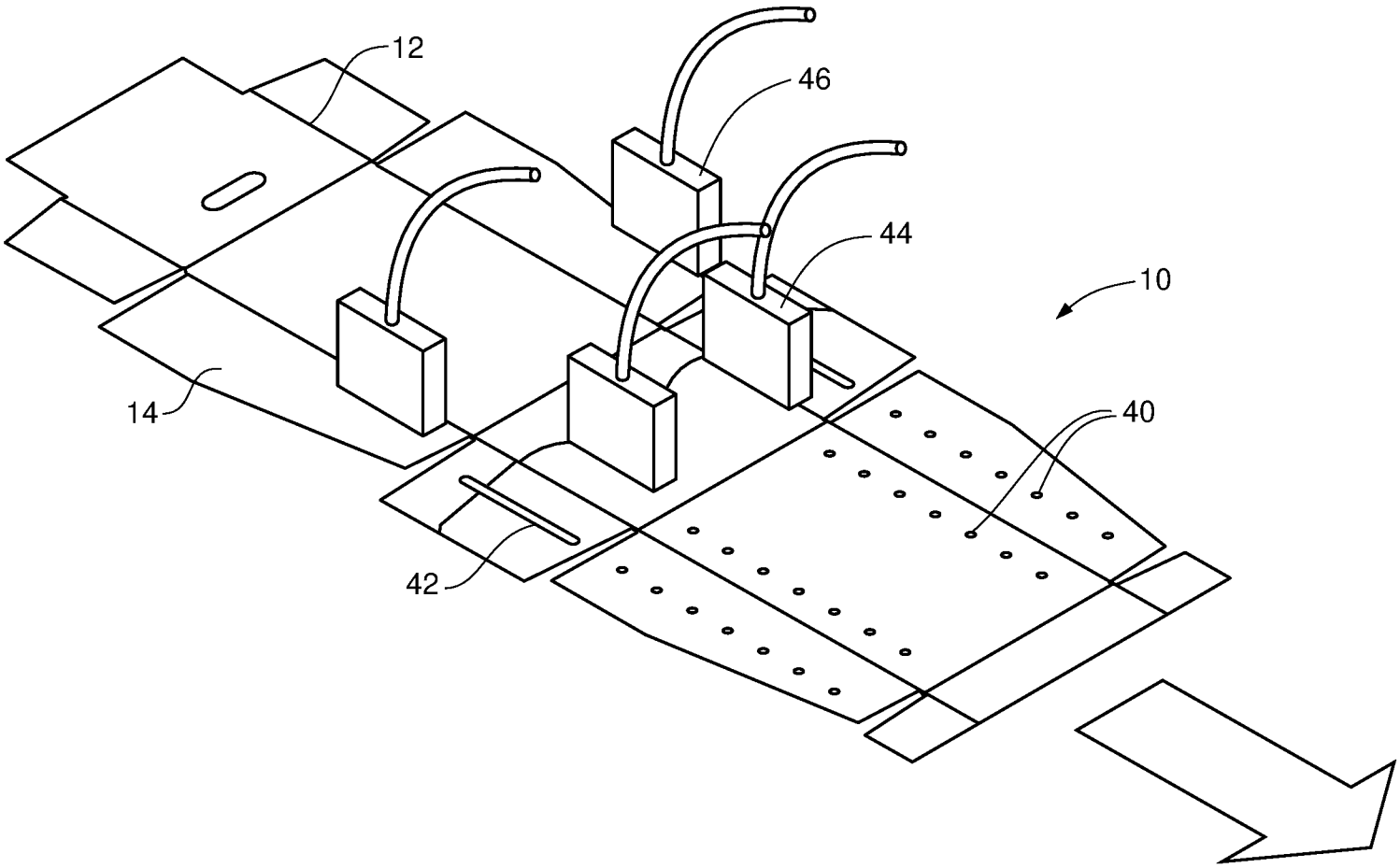
FIG. 10 is a perspective view of an alternative type of package blank to that which is shown in FIG. 2 having material depositions applied via four applicator heads.
Figure 11:
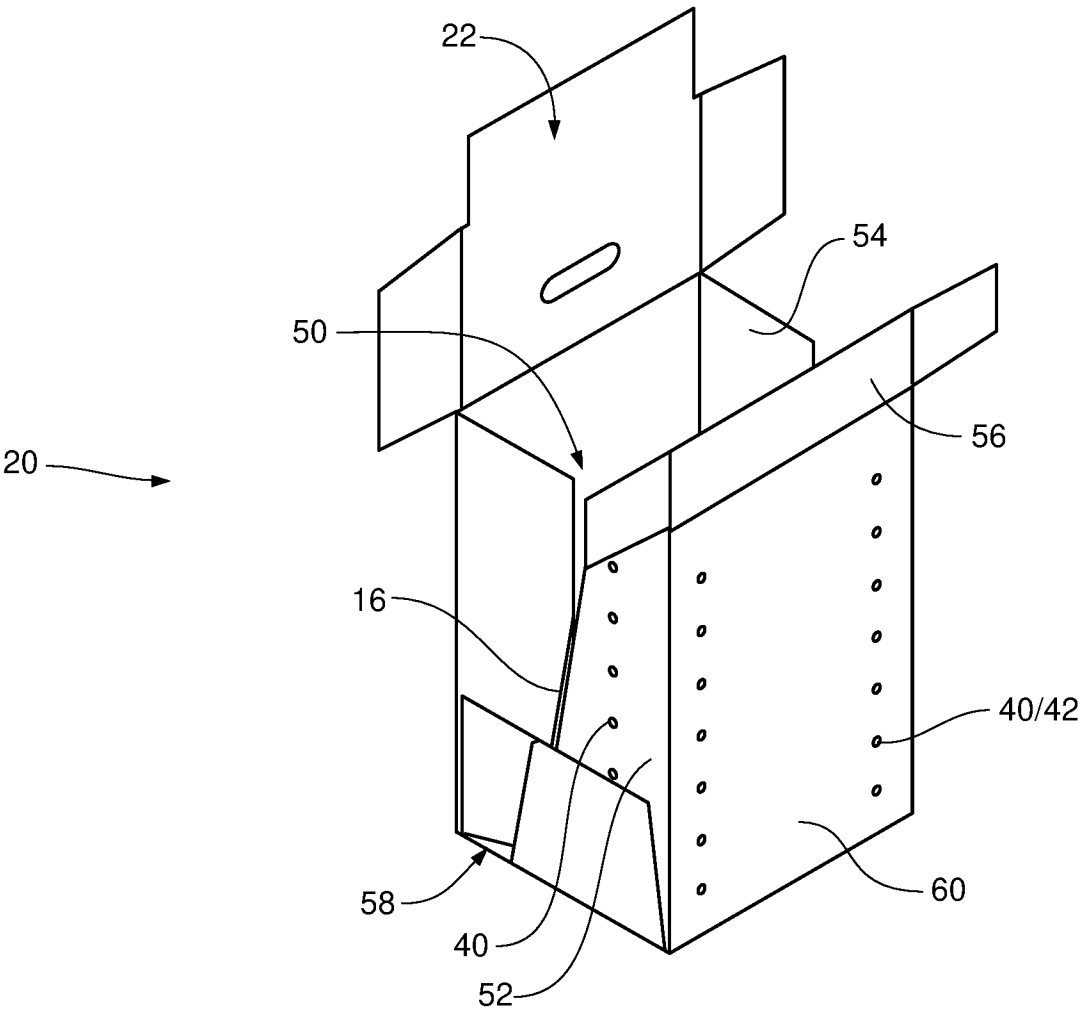
FIG. 11 is a perspective view of a package assembled from the blank shown in FIG. 10.

An alternative type of package 20, package blank 10 is illustrated in FIGS. 10-14. Here the blank 10, such as is shown in FIG. 10 is assembled to form a package 20, such as is shown in FIG. 11, that is loaded from the open front 23 with product containers 30 loaded in sequence (vs parallel loading from the "top" in the embodiment shown in FIGS. 1-9) in the manner shown in FIG. 12.

Figure 13:
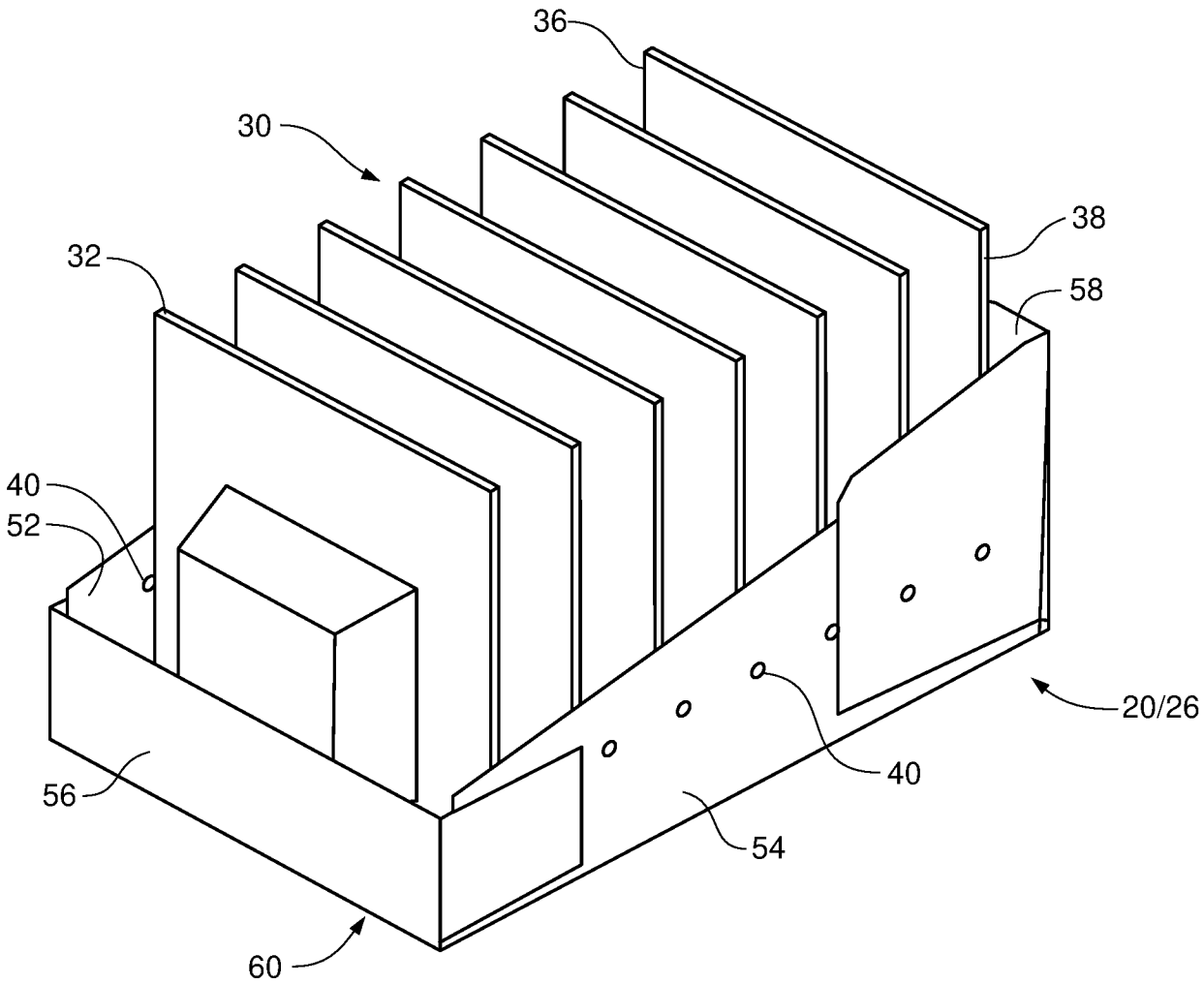
FIG. 13 is a perspective view of the display base of the package shown in FIG. 12 with the top portion fully removed and the full count of product containers within the base displayed.
Figure 14:
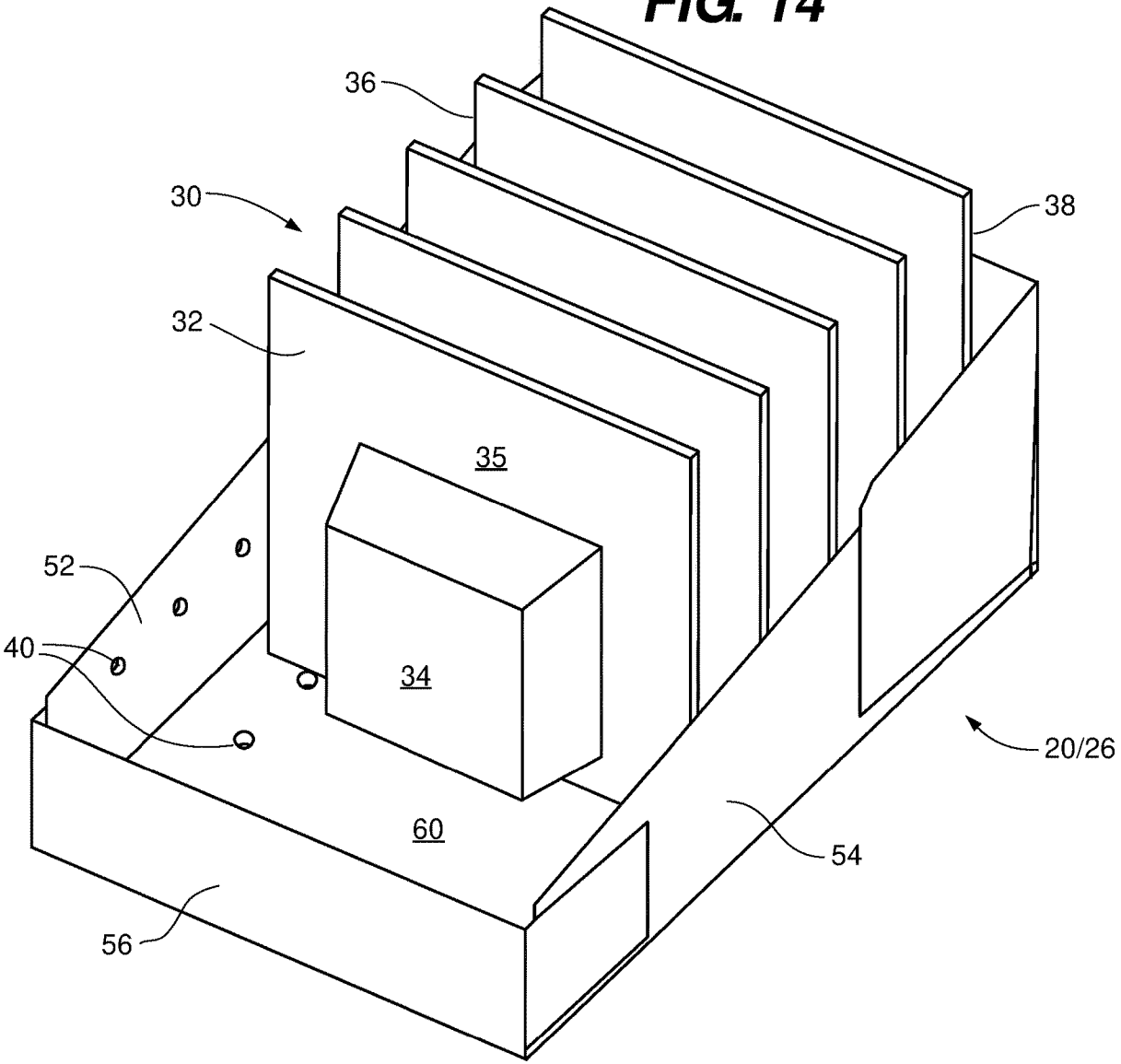
FIG. 14 is a perspective view of the retail base portion of the package shown in FIG. 13 but with initial product containers removed to illustrate the nature of the material depositions physical retention of individual product containers within the retail base.

The package 20, such as is shown in FIGS. 13-14 remains convertible by separating the package 20 into the two components such as were previously shown and described with the lid or top portion (not illustrated) removed from the display tray or base portion 26 along a tear line 16.

The blank 10, from which the package is assembled and which is illustrated in FIG. 10, is applied with adhesive 42 from adhesive applicator heads 44, for securing panels 14 of the blank together when forming the package 20 (shown in FIG. 11). Depositions 40 are deposited on regions of panels 14 that are not brought into contact with adjacent panels 14 in order to allow the depositions 40 to set or cure, forming the droplet or other structures (e.g. lines, beads, etc.) previously described and illustrated in FIG. 2*b*. Depositions 40 may be the same type of material as that of the adhesive 42 and deposited from the same type of applicator head 44 or a separate and dedicated deposition applicator head or heads 46 such as are shown in FIG. 10.

Figure 12:
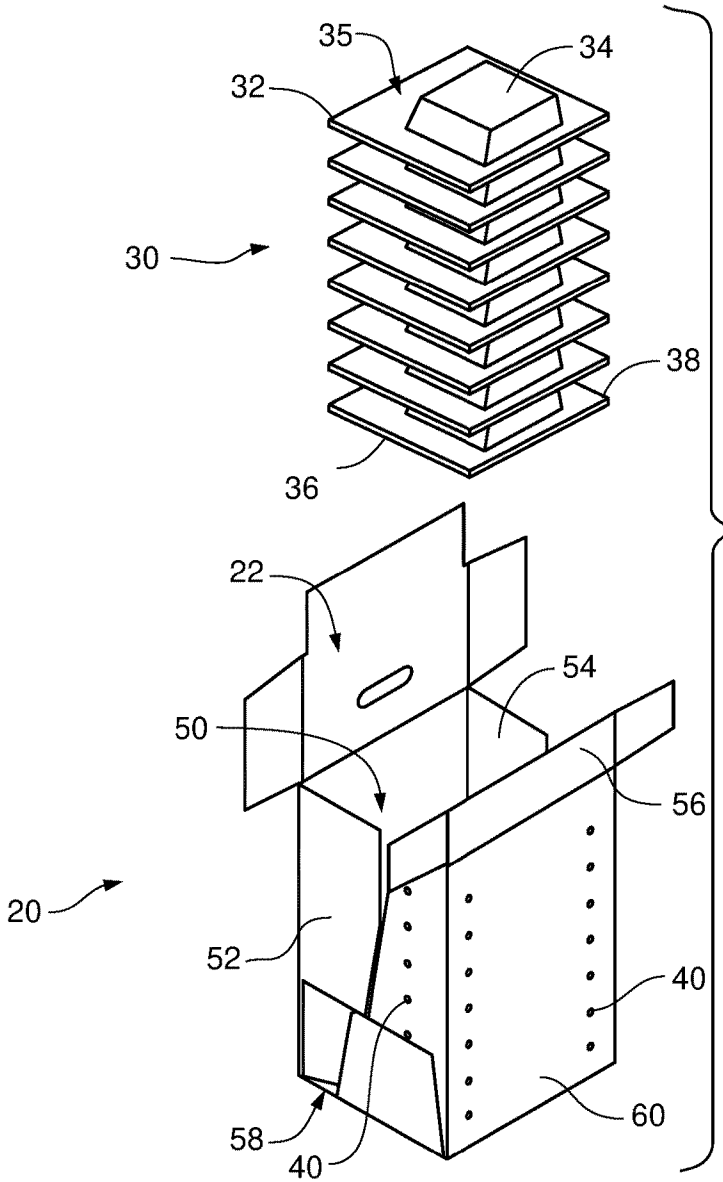
FIG. 12 is a perspective view of the package shown in FIG. 11 with product containers being loaded into the package interior through the open front of the package.

The structure and function of the depositions shown in FIGS. 10-14 as well as the manner in which they engage product containers 30 are the same as the depositions illustrated in FIGS. 1-9 and described above; but with one notable exception:

In the embodiment shown in FIGS. 10-14, the depositions 40 must have sufficient adhesion with side walls 52 and 54 to allow the sequentially inserted product containers 30 to push by the depositions 40 during the loading process as illustrated in FIG. 12, but prevent the containers 30 from falling forward (toward the front wall 56) past the immediately adjacent depositions 40 that a given product container 30 is biased against such as in the manner illustrated in FIGS. 13-14. In at least one embodiment each deposition 40 is applied in such a manner so as to have a tear-drop shape, such that the narrow part of the droplet is oriented toward the front panel 56 to provide the above type of "one way" product container loading performance described.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A method of for providing a convertible package, the method comprising:

providing a package blank for a case convertible from a shipping configuration to a display configuration, the blank comprised of twelve polygonal panels defining a first end of the blank, a second end of the blank, first and second sides of the blank, the first and second sides of the blank each extending between the first and second ends of the blank, an interior of the blank positioned between the first and second sides of the blank and extending from the first end of the blank to the second end of the blank, the first end and second end of the blank each having a linear edge defined by three polygonal panels, the first and second sides of the blank each having a non-linear edge defined by four polygonal panels, the interior of the blank is defined by two polygonal panels, a single tear line extending from the first side of the blank to the second side of the blank, the single tear line for converting the case from the shipping configuration to the display configuration;

applying a first adhesive to a first group of panels;

applying a second adhesive to a second group of panels, wherein the second adhesive is applied in the form of discrete depositions of adhesive material;

assembling the convertible package with an open top defined by at least four panels of the first group of panels, the convertible package having a bottom wall, a first side wall engaged to and extending from the bottom wall, a second side wall opposite the first side wall and engaged to and extending from the bottom wall, a front wall engaged to and extending from the bottom wall and a rear wall engaged to and extending from the bottom wall, the first side wall extending between the front wall and the rear wall along a first side of the bottom wall, the second side wall extending between the front wall and the rear wall along a second side of the bottom wall, the discrete depositions of adhesive material are positioned on the first side wall, second side wall, and the bottom wall, each of the plurality of material depositions having a height as measured from the side wall that the material deposition is positioned on, each of the discrete depositions of adhesive material positioned on the bottom wall having a height as measured from the bottom wall, the discrete depositions of adhesive material form a first pattern of spaced apart depositions on the first side wall, a second pattern on the second side wall, and a third pattern on the bottom wall, the second pattern being a mirror image of the first pattern;

loading through the open top of the convertible package a plurality of product containers, each of the plurality of product containers having a product side surface, each of the plurality of product containers being mechanically engaged by one of the discrete depositions of adhesive material on the first side wall, one of the discrete depositions of adhesive material on the second side wall, only the product side surface of each of the plurality of product containers being engaged by the discrete depositions of adhesive material on the bottom wall.

2. The method of claim 1, further comprising:

folding the at least four panels over the opening to close the convertible package.

3. The method of claim 1, wherein the first adhesive material is applied to the package blank by at least one first depositing head, and the second adhesive material is applied to the package blank by at least one second depositing head.

4. The method of claim 3, wherein the first adhesive is a different adhesive than that of the second adhesive.

5. The method of claim 1, wherein the first adhesive and the second adhesive are each selected from one adhesive of the group consisting of: hot melt adhesives, thermoset plastics, curable fluids, and any combination thereof.

6. The method of claim 1, wherein the height of each of the discrete depositions of adhesive material is selected from within the range of 1.25 mm to 2.5 mm.

7. The method of claim 1, wherein each of the discrete depositions have a tear-drop shape, the tear-drop shape having a wide portion and a narrow portion, the narrow portion being oriented toward the first end of the blank.

8. A method of for providing a convertible package, the method comprising:

providing a package blank for a case convertible from a shipping configuration to a display configuration, the blank comprised of twelve polygonal panels defining a first end of the blank, a second end of the blank, first and second sides of the blank, the first and second sides of the blank each extending between the first and second ends of the blank, an interior of the blank positioned between the first and second sides of the blank and extending from the first end of the blank to the second end of the blank, the first end of the blank having a linear edge defined by a single polygonal panel and the second end of the blank having a linear edge defined by three polygonal panels, the first and second sides of the blank each having a linear edge defined by four polygonal panels, the interior of the blank is defined by four polygonal panels, a single tear line extending from the first side of the blank to the second side of the blank, the single tear line for converting the case from the shipping configuration to the display configuration;

applying a first adhesive to a first group of panels;

applying a second adhesive to a second group of panels, wherein the second adhesive is applied in the form of discrete depositions of adhesive material, the discrete depositions having a tear-drop shape, the tear-drop shape having a wide portion and a narrow portion, the narrow portion being oriented toward the first end of the blank;

assembling the convertible package with an open top defined by at least four panels of the first group of panels, the convertible package having a bottom wall, a first side wall engaged to and extending from the bottom wall, a second side wall opposite the first side wall and engaged to and extending from the bottom wall, a front wall engaged to and extending from the bottom wall and a rear wall engaged to and extending from the bottom wall, the first side wall extending between the front wall and the rear wall along a first side of the bottom wall, the second side wall extending between the front wall and the rear wall along a second side of the bottom wall, the discrete depositions of adhesive material are positioned on the first side wall, second side wall, and the bottom wall, each of the plurality of material depositions having a height as measured from the side wall that the material deposition is positioned on, each of the discrete depositions of adhesive material positioned on the bottom wall having a height as measured from the bottom wall, the discrete depositions of adhesive material form a first pattern of spaced apart depositions on the first side wall, a second pattern on the second side wall, and a third pattern on the bottom wall, the second pattern being a mirror image of the first pattern;

loading through the open top of the convertible package a plurality of product containers, each of the plurality of product containers having a product side surface, each of the plurality of product containers being mechanically engaged by one of the discrete depositions of adhesive material on the first side wall, one of the discrete depositions of adhesive material on the second side wall, only the product side surface of each of the plurality of product containers being engaged by the discrete depositions of adhesive material on the bottom wall.

* * * * *